United States Patent [19]

Economou

[11] Patent Number: 4,896,827

[45] Date of Patent: Jan. 30, 1990

[54] MAILBOX SYSTEM

[76] Inventor: George Economou, 419 Valley Dr., Pittsburgh, Pa. 15215

[21] Appl. No.: 303,457

[22] Filed: Jan. 27, 1989

[51] Int. Cl.[4] ..... B65D 91/00

[52] U.S. Cl. ..... 232/17; 232/1 C

[58] Field of Search ..... 232/17, 1 C

[56] References Cited

U.S. PATENT DOCUMENTS

| | | | |
|---|---|---|---|
| 838,194 | 12/1906 | Larsh | 232/17 |
| 3,144,984 | 8/1964 | Ross | 232/17 |
| 4,190,192 | 2/1980 | Cornwell et al. | 232/17 |
| 4,413,770 | 11/1983 | Nye | 232/17 |
| 4,714,192 | 12/1987 | Harlow et al. | 232/17 |
| 4,753,385 | 6/1988 | Phipps et al. | 232/17 |

*Primary Examiner*—Robert W. Gibson, Jr.

*Attorney, Agent, or Firm*—Reed Smith Shaw & McClay

[57] ABSTRACT

A novel mailbox is disclosed. The mailbox utilizes a sliding mail tray which slides out of the mailbox as the mailbox door is opened and is returned to the interior of the mailbox when the mailbox door is closed. The mailbox may also include an overhanging roof portion.

3 Claims, 1 Drawing Sheet

MAILBOX SYSTEM

FIELD OF THE INVENTION

The present invention relates to mailboxes, specifically those enabling mail contained therein to slide forward as the mailbox is opened.

BACKGROUND OF THE INVENTION

Contemporary mailboxes are typically long hollow boxes sized and shaped to permit depositing and retrieval of mail, magazines, newspapers, packages, etc. One problem with contemporary mailboxes is that the elderly and the handicapped, especially those confined to a wheelchair, are unable to reach into the far recesses of the mailbox to easily retrieve all of the mail contained therein. Another common problem with contemporary mailboxes is the inability of these boxes to protect mail from becoming wet as a result of water ingressing between the open spaces between the body of the mailbox and the door. An advance in the art would be recognized if these problems could be solved.

SUMMARY OF THE INVENTION

The present invention solves these problems by providing a slidable mail tray disposed within the housing of the mailbox. The mail tray is adapted to contain mail and to slide outwardly through the opening in the mailbox housing when the mailbox door is open. The mailbox housing further includes an overhanging roof portion which extends over at least a portion of the mail tray when the tray slides outwardly through the opening in the housing.

Other details, objects and advantages of the invention will become apparent as the following description of the presently preferred embodiments and presently preferred methods of practicing the invention proceeds.

SUMMARY OF THE DRAWINGS

In the accompanying drawings, the preferred embodiments of the invention and preferred methods of practicing the invention are illustrated in which.

DETAILED DESCRIPTION OF THE INVENTION

Figure 1:
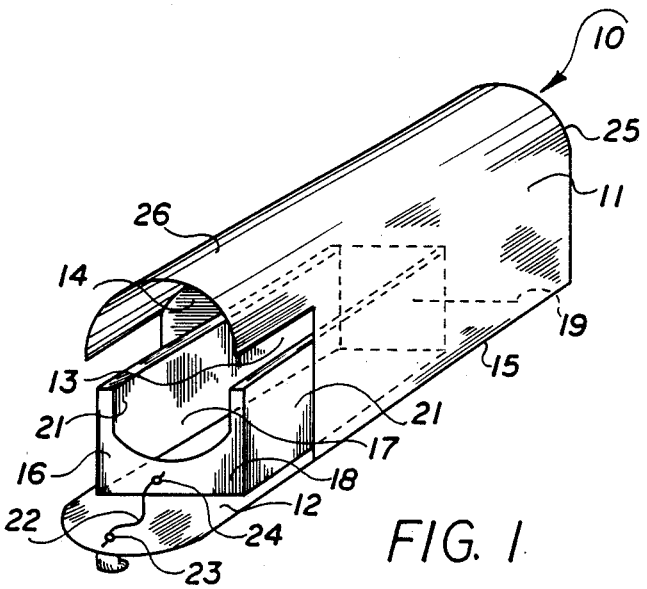
FIG. 1 represents an isometric view of a preferred embodiment of the present invention.

Referring to FIG. 1, the mailbox, generally 10, is illustrated. The mailbox 10 includes a housing 11 having a door 12. The housing 11 is essentially a hollow structure having a space 13 within which to receive mail. The door 12, which preferably opens outwardly, covers an access opening 14 to the housing 11. The housing 11 further includes a floor section 15 which forms the base of the housing.

Figure 2:
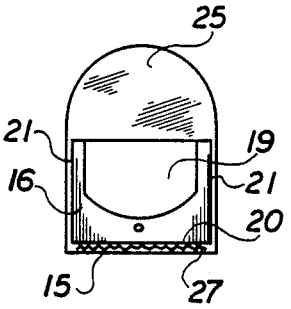
FIG. 2 represents an elevation view of a preferred embodiment of the present invention.

As illustrated in FIGS. 1 and 2, the present invention includes a tray means 16 which is slidably disposed within the housing 11. As illustrated in FIG. 2, the tray means 16 is sized to fit within the interior of the housing 11. The tray means 16 preferably includes a mail receiving section 17, a front stop 18 and a rear stop 19. Additionally, the tray means 16 preferably includes a bottom portion 20, and side portions 21. The sides 21 of the tray 16 are designed to be sufficiently high to prevent mail deposited in the tray 16 from falling out of the tray.

The tray means 16 is adapted to be slidably received within the housing 11. As the tray slides forward, mail contained by the tray 16 is maintained within the tray by the back stop 19. The front stop 18 is sized so as to permit mail to be deposited in the mail receiving portion 17 of the tray 16 by passing the mail over the front stop 18. The front stop 18 further assists in maintaining the mail so deposited within the tray 16 as the tray 16 is slid back into the housing 11.

Preferably the tray 16 is fabricated of plastic, since this prevents the tray from rusting, warping, and rotting. However, alternative materials of construction such as aluminum and weather resistant wood could also be used.

The housing 11 is preferably constructed of a rustproof material such as aluminum or plastic. Alternatively, weather resistant wood could also be used for the housing in addition to the tray.

As illustrated in FIG. 1, the tray means 16 is preferably connected to the door 12 with a connection, such as a piece of string 22. The piece of string 22 in turn is fastened to a fastener 24, in the front stop 18 of the tray 16 and a fastener 23 in the door 12. The fasteners 23 and 24 may be screw eyes, bolts, rivets, or any other attachment means known in the art. The attachment of the string from the front stop 18 to the door 12 is made in such a way to permit the tray 16 to slide outwardly through the access opening 14 in the housing 11 as the door 12 to the housing 11 is opened. After the mail has been inserted in the tray 16, the door 12 is closed, pushing the tray 16 back into the housing 11. The present invention contemplates that in addition to string 22 being used as an attachment means to the door 12, it would be possible to utilize other means, such as wire, cable, link chain, etc.

Alternative means of sliding the tray from the housing could be employed. For example, the housing may include a spring means which pushes the tray 16 through the access opening 14 when the door 12 is opened. Such spring means could be in compression when the door is closed, pressing against the rear portion 25 of the housing and the back stop 19 of the tray.

As illustrated in FIG. 1, the mailbox 10 preferably includes an overhanging roof portion 26. This roof portion 26 is adapted to extend over at least a portion of the tray 16 when the tray 16 slides outwardly through the access opening 14 in the housing 11. The roof portion 26 assists in preventing rain, snow, etc. from entering through the cracks between the door 12 and the housing 11 when the door is shut, and further assists in keeping the mail contained in the tray 16 dry as the tray slides forward through the access opening 14 in the housing 11 for removal.

The roof portion 26 may be fabricated of any durable material, although it is preferred that it be fabricated of the same material of construction as the housing 11. Ideally, the roof portion 26 is fabricated integrally with the housing 11. However, the roof portion 26 may be added later, for example, with rivets, screws, bolts, welds, etc.

The bottom portion 20 of the tray means 16 is preferably adapted to slide freely over the bottom 15 of the housing 11. For this reason, high impact polystyrene is an especially preferred material of fabrication for the tray means 16, since this material has a low coefficient of friction. Additionally, it is possible to provide the bottom portion 20 of the tray means 16 with ribbed portions 27 which further assist in reducing friction.

Alternatively, the tray means 16 could be provided with wheels or rollers of the type known to those skilled in the art. Still further, the tray means 16 and housing 11 could be provided with a roller bearing track and roller system, similar to that found in kitchen drawers and desk drawers.

Although the invention has been described in detail in the foregoing for the purpose of illustration, it is to be understood that such detail is solely for that purpose and that variations can be made therein by those skilled in the art without departing from the spirit and scope of the invention as defined by the claims.

I claim:

1. A mailbox, said mailbox comprising;

(a) a housing, said housing adapted to receive mail therein, said housing having an outwardly opening door therein, which door covers an access opening to said housing;

(b) a tray means slidably disposed within said housing, said tray means having a front stop means for assisting in containing said mail within said tray means and being adapted to contain mail therein, said tray means further adapted to slide automatically outwardly through said opening in said housing when said door is opened, by means of a connector means between said door and said front stop of said tray;

(c) an overhanging roof portion extending from said housing, said roof portion having a rounded profile and adapted to extend over at least a portion of said tray means when said tray means slides outwardly through said opening in said housing.

2. The mail box of claim 1 wherein said tray means has a rear stop means for assisting in containing said mail within said tray means.

3. The mail box of claim 1 wherein said tray means has a bottom section which slides over a floor section in said housing, said bottom section including anti-friction means.

* * * * *